United States Patent [19]

Keller et al.

[11] 4,363,585

[45] Dec. 14, 1982

[54] BALE LEVEL CONTROL SYSTEM FOR MECHANICAL HOPPER FEEDER

[75] Inventors: Alex J. Keller, Clover, S.C.; Erchard A. Fechner, Gastonia; Joseph R. Williams, Kings Mountain, both of N.C.

[73] Assignee: Automatic Material Handling, Inc., Bessemer City, N.C.

[21] Appl. No.: 224,217

[22] Filed: Jan. 12, 1981

Related U.S. Application Data

[63] Continuation-in-part of Ser. No. 78,698, Sep. 25, 1979, abandoned.

[51] Int. Cl.[3] ..... D01G 13/00; B66C 17/00

[52] U.S. Cl. ..... 414/273; 19/80 R; 19/145.5; 212/161; 318/482

[58] Field of Search ..... 414/266–270, 414/560, 561, 626, 273; 212/159, 161, 127; 19/80 R, 145.5; 318/482; 364/561, 562; 235/92 CT, 92 DN, 92 PD, 92 MP

[56] References Cited

U.S. PATENT DOCUMENTS

| | | | |
|---|---|---|---|
| 2,619,620 | 11/1952 | Tapp et al. | 318/482 X |
| 3,777,908 | 12/1973 | Keller | 414/267 |
| 3,973,683 | 8/1976 | Keller | 414/591 |
| 3,986,623 | 10/1976 | Keller | 414/281 X |
| 4,156,467 | 5/1979 | Patton et al. | 364/562 |
| 4,176,995 | 12/1979 | Wise | 414/266 |

*Primary Examiner*—Robert G. Sheridan

*Attorney, Agent, or Firm*—Richards, Shefte & Pinckney

[57] ABSTRACT

Apparatus for removing fiber portions from a selected plurality of bales and delivering the fiber to a receiver, such apparatus including a head that is lowered into contact with the top surface of such bales to grasp fibers therefrom. A control system is provided which generates a signal when the head has traveled a predetermined vertical distance toward a bale, and the signal is used to vary the sequence of pick-up or the amount of fiber picked up, from the plurality of bales to assure that the plurality of bales are maintained at substantially even heights during the sequential pick-up of fiber therefrom.

20 Claims, 11 Drawing Figures

CRANE POSITION SIGNALS

| 1 | 2 | 3 | 4 | 5 | 6 | MEMORY SIGNAL |
|---|---|---|---|---|---|---|
| X | O | X | O | O | X-L | NO LOW SIGNAL |
| O | X | O | O | X-L | | BALE 1 LOW SIGNAL |
| X | O | O | X-L | | | BALE 2 LOW SIGNAL |
| X | O | X-L | | | | BALE 3 LOW SIGNAL |
| O | O | X | O | O | X-L | BALES 1 & 2 LOW SIGNAL |
| O | X | O | X-L | | | BALES 1 & 3 LOW SIGNAL |
| X | X-L | | | | | BALES 2 & 3 LOW SIGNAL |

PROGRAM MATRIX CHART

BALE LEVEL CONTROL SYSTEM FOR MECHANICAL HOPPER FEEDER

CROSS-REFERENCE TO RELATED APPLICATIONS

This application is a continuation-in-part application of U.S. Application Ser. No. 78,698, filed Sept. 25, 1979, now abandoned.

BACKGROUND OF THE INVENTION

Modern textile mills have increasingly turned to mechanical bale opening and fiber delivery apparatus as a substitute for manually opening bales and its inherent disadvantages. Apparatus of this general type is disclosed, for example, in U.S. Pat. Nos. 3,777,908; 3,973,683, and 3,986,623.

More specifically, the aforesaid prior art patents describe apparatus that, generally characterized, includes a head that is provided with finger elements or similar fiber removing elements, and this head is arranged to travel along a plurality of bales of fiber which are arranged in a laydown adjacent a hopper or receiver. The movement of the head is controlled so that it passes above the bale laydown on an elevated track system and stops above a selected bale, whereupon the head is lowered to a point where the fiber removing elements can engage the fibers at the top surface of the bale and remove a portion of such fibers. The head is then raised, and moved to a position above the hopper where the fibers are released to fall therein for further processing, such as blending.

The movement of the head is preferably controlled automatically to travel to the selected bale positions in a predetermined sequence, and this sequence may be selectively altered to permit the movement of the head to correspond to the particular bale laydown from which it is feeding, all as described in greater detail in the aforesaid U.S. Pat. No. 3,986,623. While the automatic control, and the ability to vary the number and combinations of bale positions from which fiber is removed, substantially increases the versatility of the apparatus in removing fibers in sequence from a bale laydown having varying numbers of bales at different bale positions, there is still some problem of removing generally equal quantities of fiber from all of the bales in a given bale laydown. Additionally, while it is desirable for all bales in a given laydown to be consumed generally equally so that all of the exhausted bales can be replaced simultaneously rather than piecemeal, the above-described apparatus will often result in some bales being consumed unequally because of the normal variables in the individual bales in the laydown.

Bales may vary substantially from one another in weight, density, size and composition, which depends to some extent upon the ginning method used in forming the bale. Because of these variables, one pick-up by the head of the aforesaid apparatus will often remove a greater quantity of fiber from one bale (e.g. a less dense bale) than it will from another (e.g. a more dense bale). Since the aforesaid apparatus is designed to pick-up fiber, in a predetermined sequence, from all of the bales in a given bale laydown, it will be apparent that bales having the variables noted above may be consumed at different rates, thereby resulting in the disadvantages discussed above.

One fiber feeding machine currently in use includes a traveling pick-up head which moves along a row of bales that are arranged in clusters, with the clusters being spaced along the path of travel of the pick-up head. The head stops above each of the clusters and removes fibers simultaneously from all of the bales in the cluster, and then moves to the next cluster to remove fibers therefrom. The control system includes a memory which establishes the level of each cluster of bales after each pick-up therefrom, and the control system for the pick-up head automatically adjusts the height of the pick-up head, based on the memory input from each individual cluster, each time the pick-up head returns to each such cluster. While this control system serves to properly adjust the height of the pick-up head to remove fibers from the top surface of bale clusters having varying heights, there is no known provision in this system for varying the sequence of the pick-up head as it moves serially from one bale cluster to the next. Accordingly, there is no provision in this system for insuring that all of the individual bales in the bale laydown will be consumed substantially equally by the pick-up head.

In accordance with the present invention, the aforesaid drawbacks are substantially eliminated by providing a control feature which results in all of the bales in a laydown being consumed generally equally, even though the bales may be of varying weights, densities, sizes or compositions.

SUMMARY OF THE INVENTION

Broadly characterized, the present invention provides a control feature which senses the vertical height of each bale during the pick-up of fiber therefrom, and then regulates the movement of the pick-up head so that it will pick-up more fibers from the higher bales and less fiber from bales having a lower height until sufficient fiber has been removed from the higher bales to substantially equalize the height of all of the bales.

More specifically, there are a plurality of bales arranged at predetermined bale positions behind a hopper or receiver. The pick-up head, which may be mounted on overhead tracks for movement over the bales, includes a primary control system for causing the pick-up head to stop above each bale in a predetermined sequence and pick-up fibers which are transported by the pick-up head to the receiver. Normally, this predetermined sequence results in the pick-up head moving to a position above each bale, in series, but, as indicated above, different quantities of fiber may be removed from different bales because of the normal variances between bales, and the bales will be consumed unequally as the pick-up head makes the same number of pick-ups from each of the bales.

The present invention includes a sensing means associated with the downward movement of the pick-up head during its pick-up motion to generate a "low" signal when the head has moved downwardly a predetermined distance, thereby indicating that the vertical height of the bale is below a predetermined level. This "low" signal is received by secondary control means for the pick-up head, which then varies the normal operation of the pick-up head so that it will pick-up different amounts of fiber from the individual bales which are located behind a given hopper and which are approached by the pick-up head in a predetermined sequence.

In one embodiment of the present invention, the aforesaid "low" signal generated by the downward movement of the pick-up head varies the normal predetermined sequence of the pick-ups by the head by preventing the head from picking up fibers from the one bale for which the signal was generated until a further signal is received from at least one, and preferably all, of the other bales for a particular hopper. Accordingly, if one of the bales becomes low enough to cause a signal to be generated, the pick-up head will pass over that bale and pick-up fibers from higher bales for which no signal has yet been generated, and, as the other bales become low enough for a signal to be generated, the pick-up will likewise pass over these bales until all of the bales reach the predetermined low level, whereupon the pick-up head will return to its predetermined sequence of picking up fibers from all the bales.

In another embodiment of the present invention, the aforesaid "low" signal generated by the downward movement of the pick-up head varies the normal operation of the pick-up head so that it will pick-up a relatively greater amount of fiber from bales which have not been reduced to a height below a predetermined level while also picking up a relatively smaller amount of fiber from bales which have been reduced to such level or below. In this embodiment, it is preferred that the pick-up head continue to pick-up the normal amount of fiber from the lower bales while picking up a greater than normal amount of fiber from the higher bales. Thus, in this embodiment, the pick-up head will make a pick-up in series, from each bale in the laydown portion behind a given hopper, thereby insuring a relatively constant blend at the hopper of all the fibers in the plurality of bales, but the amount of fibers picked up from the individual bales is varied, when needed, to assure a relatively even rate of consumption of all of the bales.

The aforesaid "low" signal may be generated at more than one predetermined distance of downward movement of the pick-up head so that once all of the bales reach the predetermined low level as described above, a new signal is generated in response to one or more of the bales reaching a second predetermined low level beneath the first low level and the equalizing process is repeated until all of the bales reach the second low level.

In the preferred embodiments of the present invention, the vertical downward movement of the pick-up head is controlled by and electric drive motor, and an electrical counter responds to the rotation of the electric drive motor shaft. Since the revolutions of the electric motor shaft represents a function of the vertical movement of the pick-up head, the counter may be calibrated to generate a signal at any desired vertical position of the pick-up head beneath its first or raised position. Since the bales are positioned on a fixed supporting surface such as the floor of an opening room in a textile mill, the downward extent of movement of the pick-up head before it contacts the bale will, in effect, measure or sense the vertical height of the bales.

DESCRIPTION OF THE PREFERRED EMBODIMENT

Figures 1, 8:
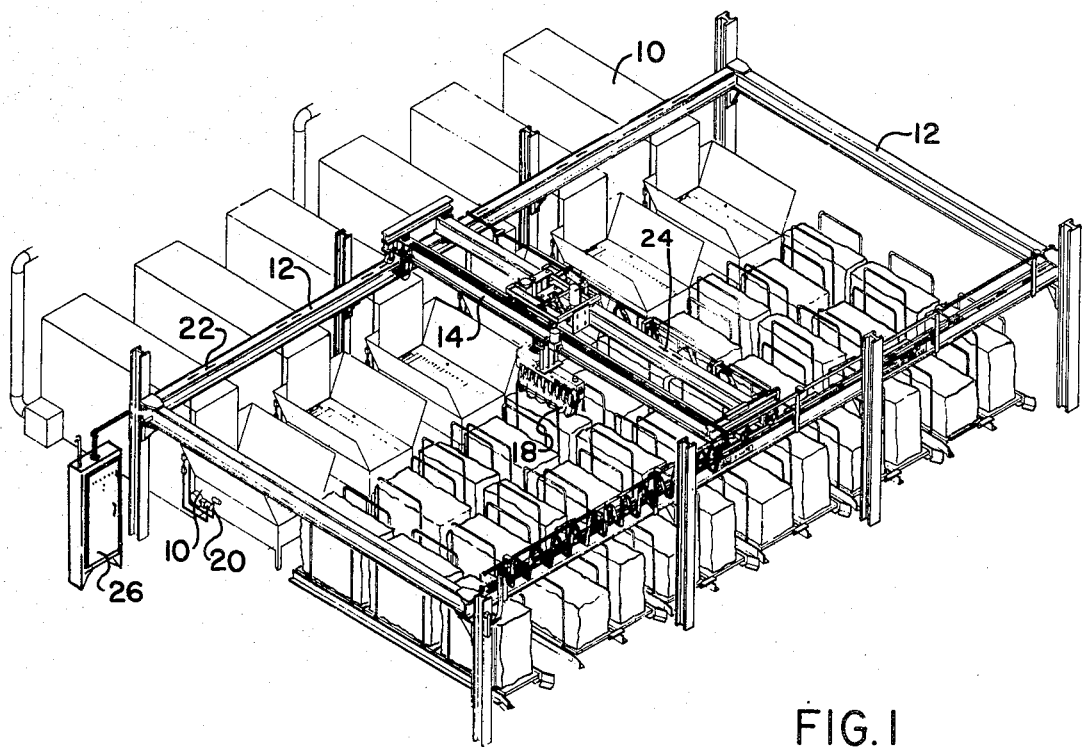
FIG. 1 is a perspective view of fiber plucking and transporting apparatus embodying the present invention.
FIG. 8 is a "Program Matrix Chart" indicating the bale pick-ups at the different positions of the crane and pick-up head, depending on the memory signal generated by the control system illustrated in FIG. 5.

Looking now in greater detail at the accompanying drawings, FIG. 1 illustrates apparatus for automatically removing and transporting fibers, such apparatus being of the same general type as that disclosed in the aforesaid U.S. Pat. Nos. 3,777,908, 3,973,683, and 3,986,623 to which reference is made for a more detailed description of the operation of such apparatus not directly related to the present invention.

Briefly summarized, such apparatus is shown in FIG. 1 and is arranged to feed a plurality of hoppers of fiber receiver machines 10 disposed beneath an elevated trackway 12 on which a crane 14 is movably carried on wheels, the crane 14 having a dolly or carriage 16 mounted thereon for movement along the rails of the crane. The carriage 16 supports a pick-up head 18 that moves vertically with respect to the carriage 16 as will be described in greater detail presently.

Each hopper 10 has extending therefrom a selected plurality of bales located at preselected bale positions behind the hopper 10, a representative bale laydown being illustrated in FIG. 1 as having two rows of bales consisting of three bales each behind the hopper 10. Each hopper 10 is provided with a photoelectric cell 20 disposed in a side wall thereof at a predetermined height for generating a signal when the fiber in the extended apron of the hopper reaches a predetermined minimum level indicating that such hopper requires additional fiber.

The elevated trackway 12 is provided with a plurality of cams 22, one located behind each row of bales, such cams 22 being used to operate conventional trip switches (not shown) on the crane 14 to position the crane 14 above any desired row of bales. Likewise, the crane 14 is provided with a plurality of cams 24, one located above each bale position in a row of bales, such cams 24 being used to operate trip switches (not shown) on the carriage 16 to position it and the pick-up head 18 above any desired bale in a particular row.

In its normal or conventional operation, the primary control circuit in the control panel 26 constantly monitors the photoelectric cells 20, and, when one such cell generates a signal indicating that its hopper requires fiber, the crane 14 is automatically moved to a position over one or the other of the bale rows behind the signaling hopper at which position it engages one of the cams 22 and stops. The dolly or carriage 16 is then automatically moved along the tracks of the crane 14 in a direction away from the hopper 10 until the first cam 24 is engaged, whereupon the carriage 16 stops above the first bale and the pick-up head 18 is then lowered from its first or raised position to a second or lowered position where it engages the top surface of the bale, removes fiber therefrom, and is raised to its first or raised position. The carriage 16 then returns along the tracks of the crane 14 to a position above the hopper 10 where the fibers held by the pick-up head 18 are released into the hopper. The carriage 16 then repeats the aforesaid process by going to the second bale in the same row, removing fibers therefrom, and transporting them to the hopper. The same process is then repeated to pluck fiber from the third or last bale in the row.

This control system may be programmed, as described in greater detail in the above-mentioned U.S. Pat. No. 3,986,623, to pick-up fibers from only one row of bales behind a hopper and to pick up fibers from only selected ones of the bale positions in each row, all of which adds to the versatility of the apparaus in picking up fibers from bale laydowns having varying numbers of bale rows and bale positions within a given row. However, it is generally desirable for the apparatus, in feeding one particular hopper, to pick-up fiber in sequence from all of the bales behind such hopper. Thus, in looking at the particular bale laydown illustrated in FIG. 1, when the photoelectric cell 20 of a given hopper signals for more fiber, the control panel 26 is normally programmed to cause the pick-up head 18 to travel, in a predetermined sequence to each one of the six bales behind the signaling hopper to make one pick up from each such bale and delivering each fiber pick up to the hopper before moving to the next signaling hopper to repeat this process.

Thus, it will be apparent that the operation described above will result in each bale behind a given hopper being plucked an equal number of times by the pick-up head 18 during the continuing operation of the apparatus. Since, as discussed above, the selected plurality of bales behind a given hopper, which may be preselected to provide a desired blend of different fibers, may have varying weights, densities, sizes and compositions, different amounts of fiber will be removed during each pick-up by the head 18 and, therefore, the bales will be consumed unequally since all of the bales receive the same number of pick-ups. This unequal consumption of the bales will require that different bale positions will have to be replaced with new bales at different times, which may require shutting down the apparatus at more frequent intervals while the consumed bales are replaced.

In accordance with the present invention, the control of the pick-up head 18 is modified to cause it to pick up more fibers from bales that have a greater vertical height than other bales behind a given hopper, thereby resulting in the bales being consumed at a substantially equal rate.

Figure 2:
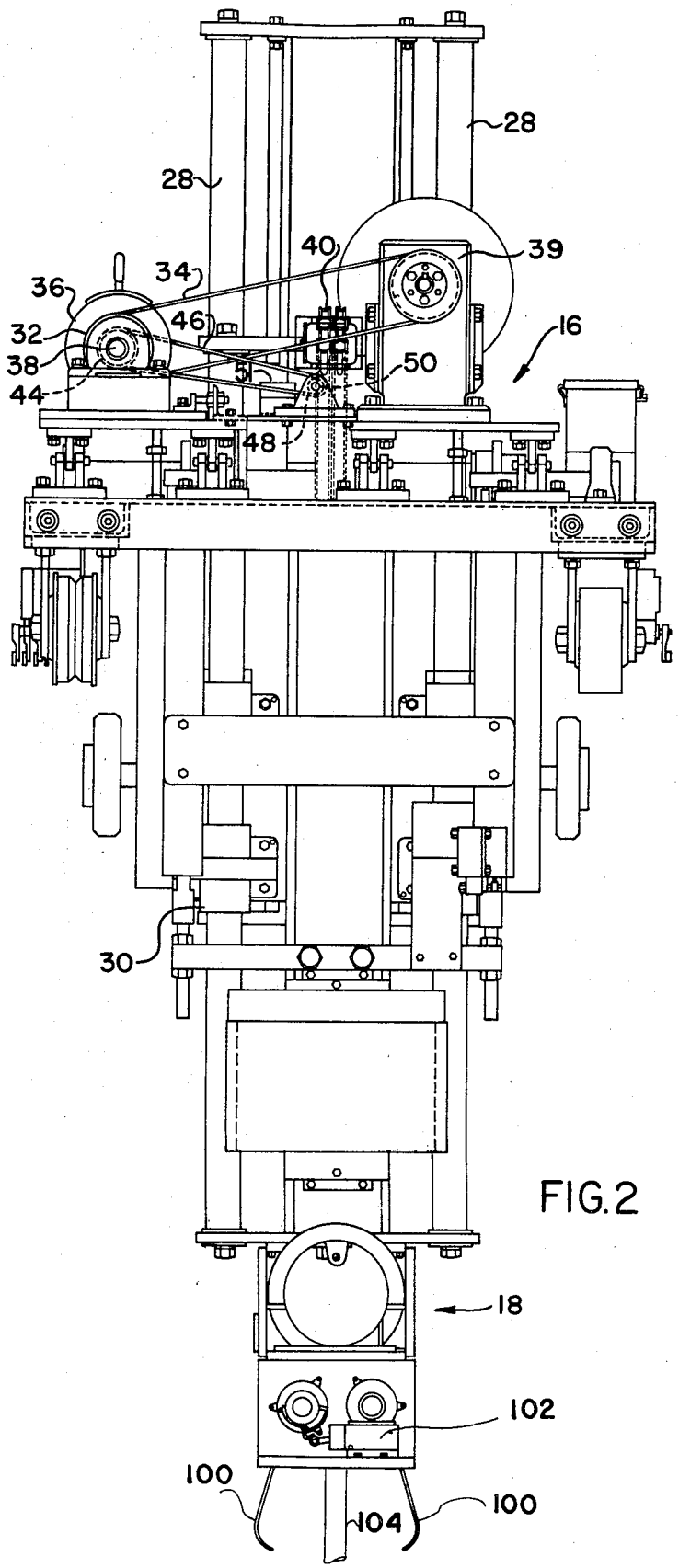
FIG. 2 is a side elevational view of the pick-up head and carriage therefor.
Figure 3:
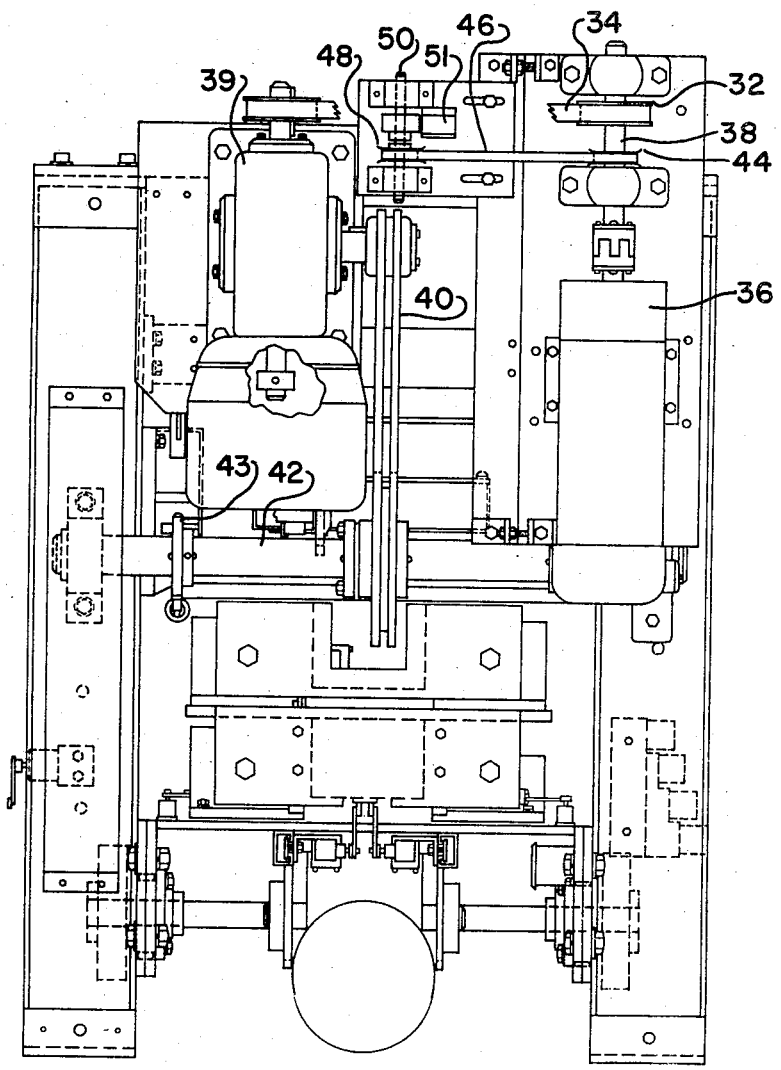
FIG. 3 is a plan view of the pick-up head and carriage illustrated in FIG. 2.

As best seen in FIGS. 2 and 3, a pair of post 28 are supported for vertical movement in bearings 30 fixed to the carriage 16 (one bearing 30 being shown in FIG. 2) with the lower end of the post 28 supporting the pick-up head 18. A drive motor 36 is mounted on the carriage 16 and has a drive shaft 38 extending therefrom to support a first pulley 32 connected by a belt 34 to a gear reduction unit 39 which operates, through a chain drive 40, a shaft 42 having sprockets 43 fixed at the ends thereof, one of which is illustrated in FIG. 3. Each of the sprockets 43 has a chain (not shown) passing thereover, with the ends of the chains being connected to the pick-up head 18 in the general manner as that described in greater detail in the aforementioned U.S. Pat. No. 3,973,683. To lower the pick-up head 18 from its first or raised position, the drive motor 36 is operated to turn the shaft 42 in one direction for causing the chain sprockets 43 to feed out the chains and permit the pick-up head 18 to be lowered while being supported by the vertical posts 28. To raise the pick-up head 18, the shaft 42 is rotated in the opposite direction, by the drive motor 36, to cause the sprockets 43 to move the chains upwardly.

As seen in FIG. 2, the pick-up head 18 includes a plurality of opposed finger elements 100 operated by a drive arrangement 102 to pivot the finger elements 100 toward and away from one another to engage and separate fibers from the top surface of bale when the pick-up head 18 is lowered to a position immediately above such top surface in the same general manner as that described in greater detail in aforesaid U.S. Pat. No. 3,777,908. Additionally, the pick-up head 18 includes a downwardly extending probe or feeler element 104 that controls the top surface of a bale as the pick-up heads 18 approaches such surface during its downward movement, such feeler element 104 acting to sense the proximity of the bale and to cause the drive arrangement 102 to close the finger elements 100 when the pick-up head 18 reaches a predetermined location just above the top surface of the bale in the same general manner as that described in greater detail in the aforesaid U.S. Pat. No. 3,777,908.

In accordance with the present invention, the drive motor shaft 38 has a second pulley 44 fixed thereto for driving an endless belt 46 disposed about a driven pulley 48 that operates the shaft 50 associated with a conventional pulse generating switch 51 that generates a pulse for each revolution of the shaft 50, and these pulses are transmitted to a conventional electronic counter 52 (see FIG. 6) in the control panel 26 which receives the pulses and generates a signal after a predetermined number of such pulses have been received. The counter 52 may be set to generate a plurality of signals, each signal representing a different number of revolutions of the counter shaft 50. Since the drive shaft 38 simultaneously drives the chain sprockets 43 and the counter shaft 50, and since the vertical position of the pick-up head 18 is determined by the rotation of the chain sprockets 43, it will be apparent that the signals generated by the counter 52 will be a function of the vertical distance of the pick-up head 18 from its first or raised position, and the counter 52 may be calibrated to generate a signal at any one or more such predetermined distances. These signals are received by the secondary control circuit for the pick-up head 18 to vary the operation of pick-up by the head as described below.

Figure 5:
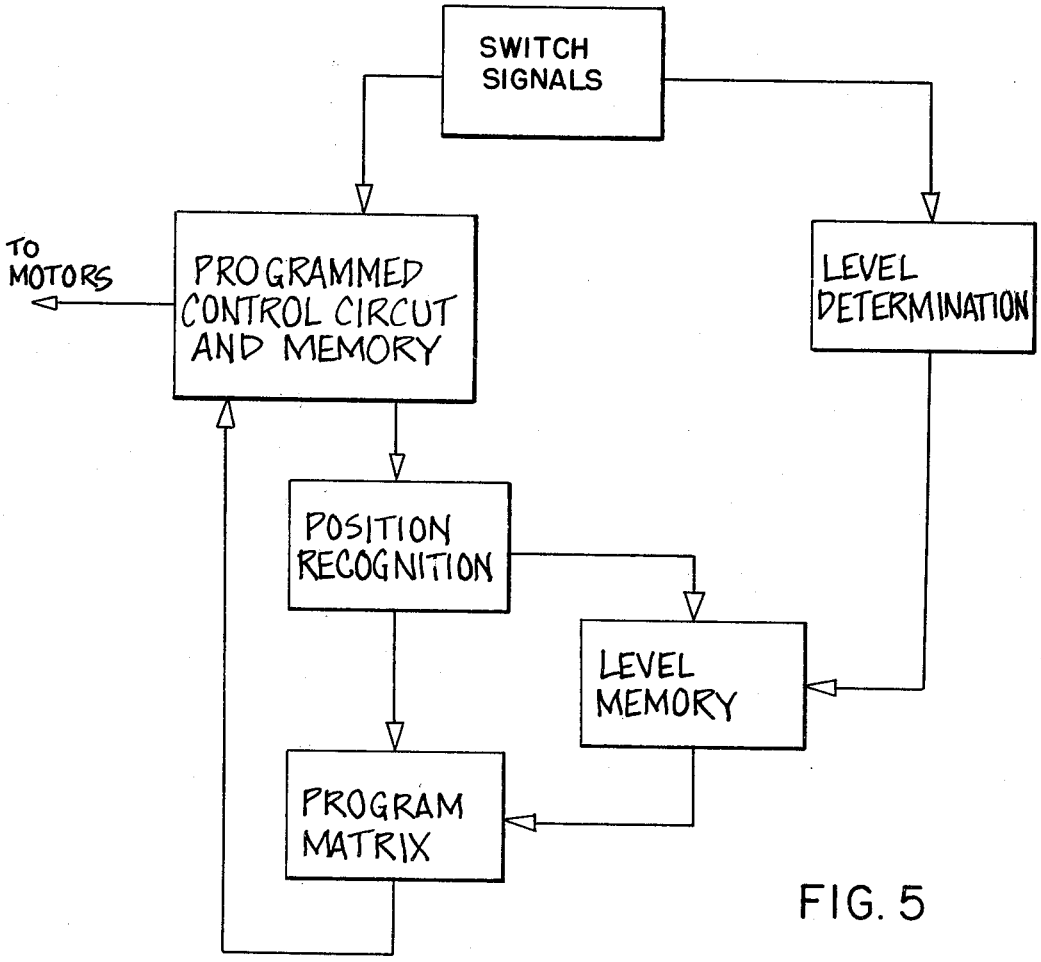
FIG. 5 is a diagrammatic illustration of the control system for one embodiment of the present invention.

As shown in simplified diagrammatic form in FIG. 5, the box labeled "switch signals" represents the signals which are normally received from the trip switches operated by the cams 22 and 24, and the signals from the photoelectric cells 20, and these signals are fed to the primary control circuit for the apparatus which is indicated by the box labeled "Programmed Control Circuit and Memory" which produces the appropriate electrical signals for operating the motors of the crane 14, the carriage 16 and the pick-up head 18 in its normal or conventional manner as described above and in the three above-mentioned prior patents. In accordance with one embodiment of the present invention, the diagrammatically represented boxes entitled "Level Determination," "Level Memory," "Position Recognition" and "Program Matrix" have been added to the control system shown in FIG. 5 to provide for the equal consummation of the bales as discussed above.

Figure 6:
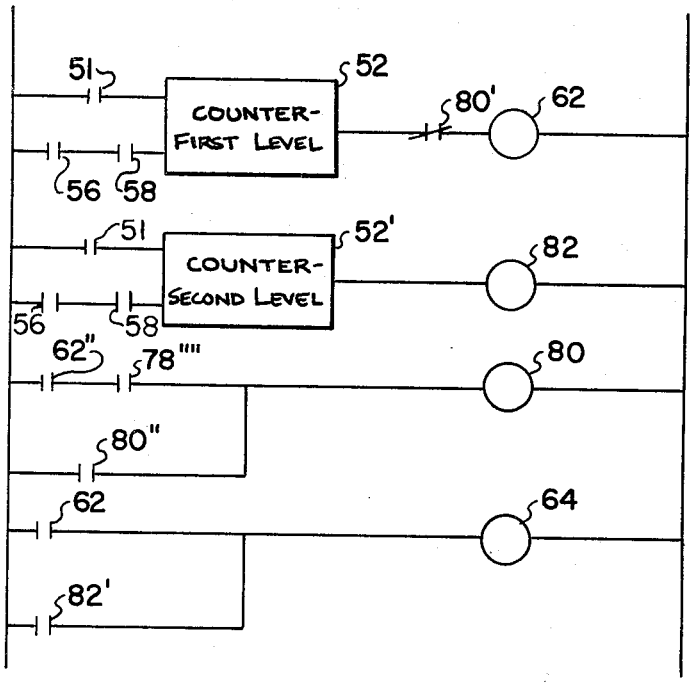
FIG. 6 is a diagrammatic illustration of an exemplary "Level Memory" circuit represented in FIG. 5.
Figure 7:
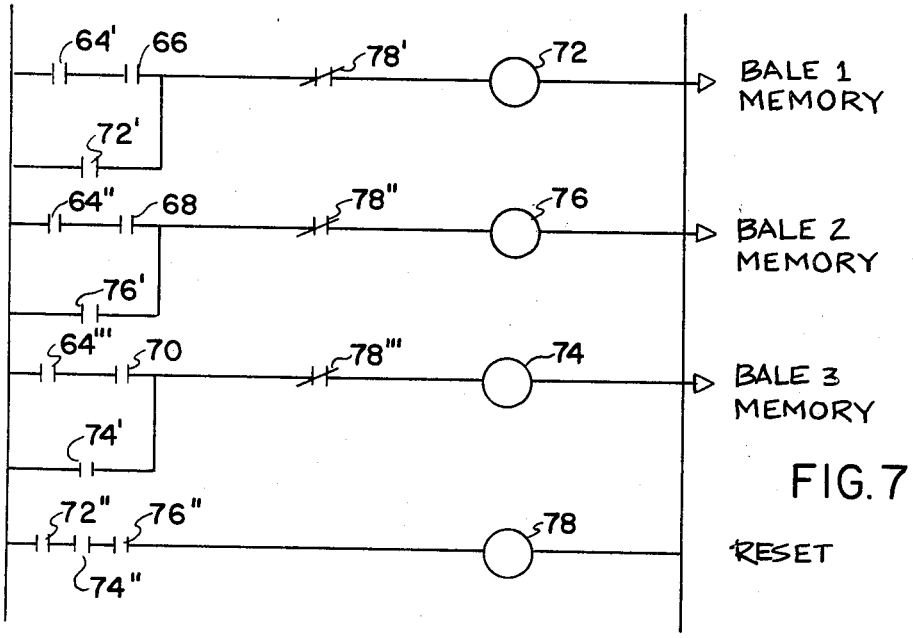
FIG. 7 is a diagrammatic illustration of an exemplary "Level Determination" circuit represented in FIG. 5.

FIGS. 6, 7 and 8 show in simplified diagrammatic form a typical circuit corresponding to the "Level Determination" box, the "Level Memory" box, and the "Program Matrix" box, respectively, in FIG. 5. It is to be understood that FIGS. 6, 7 and 8 represent such circuits for only one row of three bales behind one hopper 10, and since similar circuits would be utilized for each of the bale rows behind each hopper 10, the explanation of the circuits in FIGS. 6, 7 and 8 would apply also to additional corresponding circuits for other rows of bales behind other hoppers 10. Also, it is to be understood that the circuits illustrated in FIGS. 6, 7 and 8 are merely typical and a variety of equivalent circuits could be employed to provide a similar result.

Looking, then, at FIG. 6, a "Level Determination" circuit is shown which includes a counter represented by two boxes 52 and 52'. In fact, only one counter, described above, is used, but for purposes of understanding the circuit in FIG. 6 the counter is illustrated in two boxes, with box 52 representing the counter when it generates a first signal, as described above, when the pick-up head 18 reaches a first predetermined vertical distance beneath the carriage 16, such level being reepresented by upper line A in FIG. 4, and with box 52' representing the counter when it generates a second signal at a lower predetermined position of the pick-up head 18, such lower level being represented by line B in FIG. 4. In circuit with counter 52 is an enabling line which includes a normally open switch 56 that is located on the control panel 26 to be manually closed when the apparatus is being operated in its normal automatic mode, and a switch 58 which is also normally open whenever the pick-up head 18 is in its fully raised position with relation to the carriage 16. When the crane moves, under automatic operation, to a position above a bale and the pick-up head 18 begins its downward vertical movement, the switch 58 closes and since switch 56 has also been closed, the counter 52 is enabled and ready to receive the above-described pulses from the pulse generating switch 51 which is also shown in FIG. 6. As described above, the counter 52 is calibrated so that it will not generate a signal until a predetermined number of such pulses have been received indicating that the pick-up head 18 has reached a predetermined vertical distance beneath the carriage 16. Until such predetermined number of pulses has been received by the counter 52 it is, in effect, an open switch so that the secondary bale leveling circuit is ineffective, and the pick-up head 18 continues to pluck fibers from all of the bales behind the hopper in its normal predetermined sequence. It should also be noted that each time the pick-up 18 returns to its raised position, the switch 58 opens to reset the counter 52 whereupon it begins at zero when pulses are received during the next downward movement of the pick-up head 18.

When sufficient pulses are received from the pulse switch 51, the counter 52 then completes the circuit through normally closed contact 80' to energize the relay 62. Upon energization of the relay 62, it closes normally open contact 62' which energizes relay 64, and relay 64 then closes all three normally open switches 64', 64'', and 64''' in the "Level Memory" circuit illustrated in FIG. 7. The normally open switch 66 is closed in response to a signal from the "Position Recognition" box in FIG. 5 indicating that the carriage 16 and pick-up head 18 are positioned directly above the first bale in a bale row behind a hopper 10, normally open switch 68 is closed in response to a corresponding signal indicating that the carriage 16 and pick-up head 18 are above the second bale in the row, and normally open switch 70 is likewise closed when the carriage 16 and pick-up head 18 are positioned above the third bale in the row.

Accordingly, all three switches 64', 64'' and 64''' are closed when counter 52 has received its predetermined number of pulses from switch 51, and one of the three switches 66, 68 or 70 will be closed depending on the position of the carriage 16 and the pick-up head 18. Assuming they are above the first bale when counter 52 is energized, relay 72 will be energized to close normally open contacts 72' and 72'', and, as indicated at the right in FIG. 7, a "low signal" is retained in the "Level Memory" box (FIG. 5) for the first bale.

As will be explained below, the carriage 16 and pick-up head 18 will not thereafter stop at the first bale, but will remove fibers only from the other two bales in the row until counter 52 again receives the aforesaid predetermined number of pulses from switch 51 from all of the bales in the row.

Assuming that the carriage 16 and pick-up head 18 are positioned above the third bale in the row when the counter 52 receives the predetermined number of pulses, switch 70 will be closed to energize relay 74 which closes normally open contact 74' and 74'', and maintains a "low signal" in the "Level Memory" box (FIG. 5) for the third bale which will not thereafter have fibers removed therefrom until all bales in the row reach the preselected low level. Similarly, with the pick-up head 18 above the second bale, and with the counter 52 receiving the predetermined number of pulses, the relay 76 will be energized to close normally open contacts 76' and 76'' and maintain a "low signal" in the "Level Memory" box for the second bale. When contact 76'' closes, a circuit will be completed through relay 78 which will open contacts 78', 78'' and 78''' in FIG. 7 to thereby reset all of the memory circuits in FIG. 7. Also, energization of relay 78 closes normally open contact 78'''' in FIG. 6 which energizes relay 80 to open normally closed contact 80' which resets the circuit through counter 52. Thus, when all three bales in the row have reached a predetermined low level, the level determination circuit in FIG. 6 and the level memory circuit in FIG. 7 are both returned to their original conditions, and the pick-up head 18 will thereafter pick-up fibers from all three bales in its normal predetermined sequence.

To visualize the sequence of the pick-up by the head 18 in response to the aforementioned "low signals" being maintained in the "Level Memory", reference is made to the Program Matrix Chart in FIG. 8. In FIG. 8, the numbers 1–6 across the top of the chart represent the six sequential signals which will be generated by the cams 24 (FIG. 1) each time the carriage 16 is moved along the tracks of crane 14 to remove fibers from all three bales in a back row. In the first horizontal line of the FIG. 8 chart, "no low signal" indication at the right represents the condition when no low signal has been generated in the level memory circuit, thereby indicating that none of the three bales have reached the first predetermined low level for which the level control has been set. In this condition, the apparatus operates in its normal or conventional manner to pick up fibers from all three bales in a predetermined sequence as follows. When the carriage begins its outward movement from the hopper 10 above any bale row, it will first engage the first cam 24, which is represented by the signal numeral "1" in FIG. 8, and the pick-up head 18 then removes fiber from the first bale after which the carriage returns to the hopper 10 to release the fiber. The carriage then immediately starts outwardly again and engages the first cam 24, which is represented by signal numeral "2" in FIG. 8, and passes thereover until the second cam 24 is engaged, which is represented by numeral "3" in FIG. 8. After the pick-up head removes fiber from the second bale, returns to the hopper, and starts outwardly again it will engage and pass over the first cam 24, represented by numeral "4" in FIG. 8, engage and pass over the second cam 24, represented by the numeral "5" in FIG. 8, and engage the third cam 24, represented by the numeral "6" in FIG. 8, whereupon it will stop, pick up fibers from the third bale and return to the hopper 10 to release the fibers. In FIG. 8, the symbol "X" represents a pick up of fiber by the pick-up head 18, the symbol "0" represents that the pick-up head 18 passes over a cam 24 and the bale therebeneath rather than stopping for a pick-up from such bale, and the symbol "X-L" represents the last pick-up for a given bale row. Thus, in the "no low signal" or normal condition described above, the pick-up head 18 will stop at "1, " "3" and "6" for a pick-up from the first, second and third bales, respectively.

Figure 4:
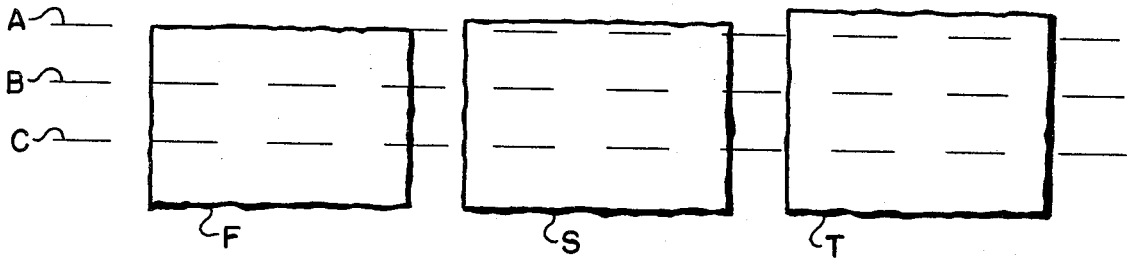
FIG. 4 is an illustration of a plurality of bales having varying vertical heights, and showing the plurality of predetermined vertical heights at which the levels of the bales are equalized in accordance with the present invention.

The remaining six horizontal lines in FIG. 8 indicate the bale pick-ups and the bale passes by the pick-up head 18 when any one of the three bales has generated a low signal, or when any combination of two bales where a low signal has been generated all as indicated by the "memory signal" column at the right of FIG. 8. For example, FIG. 4 illustrates the three bales in a row, with the first bale "F" having reached the first predetermined low level A which will cause a low signal to be generated as described above, and with the second and third bales, "S" and "T" respectively, above the level A. Looking at this condition in the chart of FIG. 8, it is represented at the second horizontal line in the chart, and it will be observed that the pick-up head will pass over the first cam signal "1," thereby passing over the low first bale, and go directly to the second cam signal "2" where it will stop and pick up fiber from the second bale, which is not low. Then, the pick-up head will return to the hopper, release the fiber picked up from the second bale, and start outwardly again. It will pass over the next two cam signals 3 and 4 above the first two bales, and make its last pick-up from the third bale at cam signal 5.

If two of the three bales in a row are low, the pick-up head 18 will pass over both of these bales and will make two pick-ups from the one bale which is not low. For example, the horizontal line in FIG. 8 represented by the designation "Bale 1 & 2 Low Signal" illustrates a condition where the first and second bales in a row have reached a level beneath the predetermined low level A (FIG. 4) but the third bale has not. Accordingly, the pick-up head will pass over the first and second bales (represented by the "0" under "1" and "2" in FIG. 8), pick up from the third bale ("X" under 3 in FIG. 8), return to the hopper, move outwardly again over the first two bales ("0" under "4" and "5" in FIG. 8), and make a second, and last, pick-up from the third bale ("X-L" under "6" in FIG. 8).

The condition set forth in the "Program Matrix" box (FIG. 5) is transmitted to the primary "Programmed Control Circuit and Memory" box to operate the motors for the carriage 16 and pick-up head 18 in accordance with the secondary level control circuit.

Thus, it will be apparent from FIG. 8 that whenever any bale in a row reaches a predetermined low level so as to generate a signal, the control for the apparatus will prevent the pick-up head 18 from thereafter removing fiber from the low bale until all of the three bales have reached a corresponding low level. When all three of the bales have reached the predetermined low level, the electrical control system is reset, as described above, so that the apparatus then returns to its normal sequence of removing fibers from all three bales in a row whenever a signal is received from the photoelectric cell 20 of the hopper for such three bales.

The present invention also contemplates establishing a plurality of bale levels, each having a different predetermined height, as represented by the lines A, B and C in FIG. 4. Thus, looking again at FIG. 6, the second counter 52', as indicated above, represents a condition when the counter is calibrated to close its circuit when a second predetermined number of pulses have been received from the pulse switch 51, such second predetermined number of pulses being greater than the first predetermined number of pulses which energizes the first counter 52 and, therefore, representing a greater predetermined vertical distance of the pick-up head 18 beneath the carriage 16. Accordingly, after the level determination circuit in FIG. 5 and the level memory circuit in FIG. 7 have been reset as described above upon all bales reaching level A in FIG. 4, whenever one of the three bales reaches level B in FIG. 4, the second or greater predetermined number of pulses will be received by the counter 52' which will close the circuit through relay 82, which will close normally open contact 82' to complete the circuit through relay 64. It will be apparent that the circuits in FIGS. 6 and 7 will operate in the same manner for counter 52' as they do for counter 52 as described in detail above, and there is no necessity for repeating the description of the circuit operations. Accordingly, when any of the bales in a row reach predetermined low level B (see FIG. 4), the pick-up head will be prevented from picking up fibers from any such bale until all of the bales in the row have reached level B.

It will be apparent that the counter 52 can be calibrated to generate signals at more than just the two predetermined number of pulses described above, so that a greater number of predetermined bale levels can be established, as indicated, for example, by the third level C in FIG. 4. Also, the predetermined bale levels, such as shown at A, B and C in FIG. 4, may have any desired vertical height by simply adjusting the counter 52 to generate signals at predetermined numbers of pulses corresponding to the desired bale heights.

In the above-described embodiment of the present invention, generally equal consumption of the plurality of bales is obtained by the pick-up head passing over the lower bales and picking up fiber from higher bales. In a second embodiment of the present invention, generally equal consumption of the bales is obtained by the pick-up head picking up greater amounts of fiber from the higher bales and lesser amounts of fiber from the lower bales, but the pick-up head picks up some fiber from each bale behind a hopper in series to thereby improve the overall quality of the blend of the fibers as discussed above.

In the second embodiment of the present invention, the apparatus shown in FIGS. 1-4 and the circuit shown in FIG. 6 are identical to that described above, and FIGS. 9-12 schematically illustrate control circuitry for operating the apparatus of FIGS. 1-4 in accordance with the second embodiment of the present invention. It is again to be noted that the details of the particular circuitry shown diagrammatically in simplified form in FIGS. 9-12 form no part of the present invention, and other equivalent circuits could be used without departing from the scope of the present invention.

Figure 9:
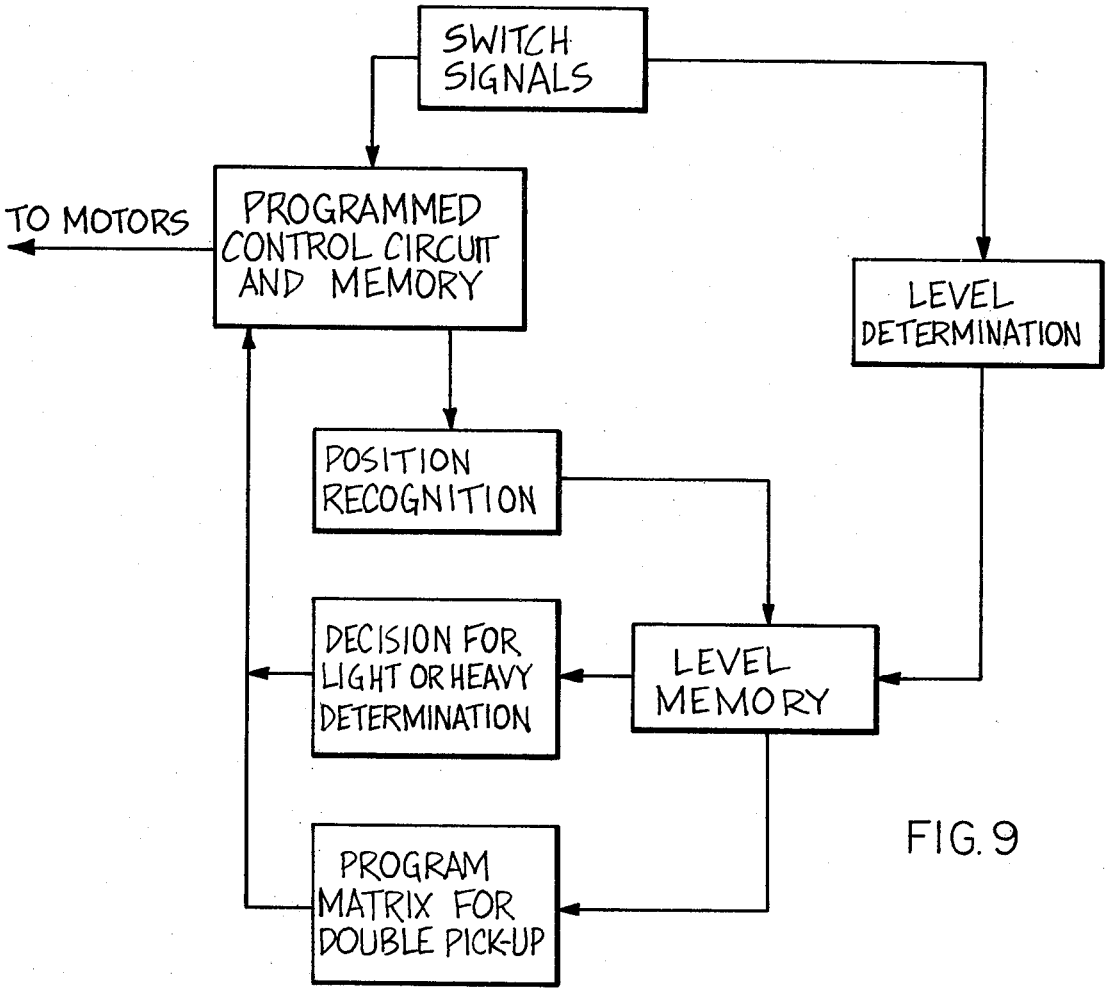
FIG. 9 is a diagrammatic illustration, generally similar to FIG. 5, showing the control system for a second embodiment of the present invention.

FIG. 9 is generally similar to FIG. 5, described above, and the box labeled "Switch Signals" represents the signals normally received from the trip switches operated by the cams 22 and 24, and the signals from the photoelectric cells 20, and these signals are fed to a primary control circuit for the apparatus indicated as "Programmed Control Circuit and Memory" for the same purpose as that described above in connection with FIG. 5. FIG. 6, described above, represents that "Level Determination" box in FIG. 9, and FIG. 7, described above, represents the "Level Memory" box in FIG. 9, except that the relays 72, 74, 76 and 78 are used in conjunction with a new control circuit being represented by the box "Decision For Light or Heavy Determination" in FIG. 9 and being shown in greater detail in FIG. 10.

In the second embodiment of the present invention, the pick ups of fiber from different bales is varied depending upon the height of the bale, and this variable pick-up is obtained by controlling the closing of the pick-up fingers 100 (see FIG. 2) that extend from the pick-up head 18 and that are closed by the drive arrangement 102 located in the pick-up head 18, such closing of the fingers 100 causing them to engage a layer of fibers from the bale surface and remove such layer for delivery to the hoppers 10 as described above. It will be appreciated that the amount of fiber picked up by the fingers 100 will depend upon the vertical position of the pick-up head 18 at the time the drive arrangement 102 closes the fingers 100. More specifically, the greater the spacing of the pick-up head 18 above a bale at the time the fingers 100 are closed, the less fiber will be engaged and removed from the bale by the fingers 100. Thus, the second embodiment of the present invention acts to control the closing of the finger elements at different positions of the pick-up head 18 above a bale, thereby varying the amount of fiber picked up.

Preferably, the pick-up head 18 normally operates to pick-up a relatively small amount of fiber from each bale. However, when this normal operation results in some of the bales behind a hopper being consumed faster than others so that some bales are higher than others, the control circuit, described above, will cause the fingers 100 to be closed when the pick-up head 18 is closer to the higher bales so that relatively large amounts of fiber will be picked up from the higher bales.

To obtain this result, the control circuits in FIGS. 6, 7, 9, and 10 are utilized to delay, through conventional time delay devices, the closing of the finger elements 100 by motor 102 when a heavy pick-up (larger amounts of fiber) is to be made from a bale, whereas no delay is imposed on the finger element closing operation when a light pick-up is to be made. Preferably, such conventional time delay devices are interposed in the electrical circuit for operating the drive motor 36 which raises and lowers the pick-up head 18, and they serve, when energized to delay or slow down the normally constant speed of movement of the pick-up head 18 as it approaches its aforesaid lowermost position adjacent the top surface of the bale to be plucked (represented as $F_1$ in FIG. 11); to delay the beginning of the upward movement of the pick-up head from such lowermost position (represented as $F_2$ in FIG. 11); and to delay or slow down the normally constant speed of the pick-up head 18 as it moves upwardly from such lowermost position (represented by $F_3$ in FIG. 11). Additionally, in normal operations, where a light pick-up is made, the energization of the drive arrangement 102 which closes the finger elements 102 is delayed slightly so such closing occurs after the pick-up head has begun its upward movement from the bale thereby resulting in such finger engaging a smaller amount of fiber. When, however, a heavy pick-up is desired, the finger elements are closed when the pick-up head reaches its lowermost position, without delay, thereby causing more fiber to be engaged by the fingers.

Figure 11:
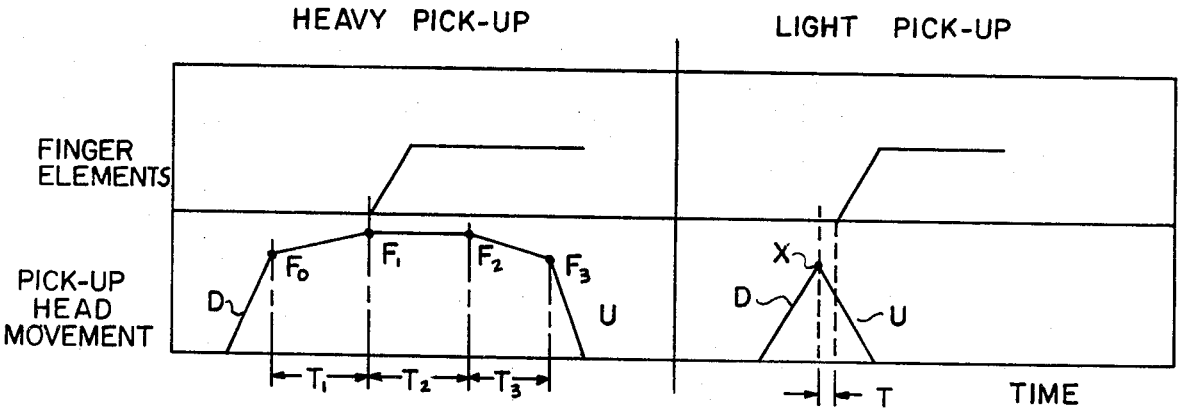
FIG. 11 is a diagrammatic illustration showing the sequence of operation of the boom and finger operation for light and heavy fiber pick-ups.

The effect of the foregoing is diagrammatically illustrated in FIG. 11 for both a light pick-up and a heavy pick-up. Thus, at the right side of FIG. 11 it will be seen that a light pick-up results when the pick-up head moves downwardly (line D) to its lowermost point (point X), and then immediately moves upwardly (line U) without delay. Also, the closing of the finger elements is delayed for a predetermined time period $T_4$ after the pick-up head 18 has started its upward movement. By contrast, the left side of FIG. 11 illustrates the operation for a heavy pick-up, and it will be seen that as the pick-up head 18 moves downwardly toward its lowermost point (line D), there is a first time period $T_1$ during which the speed of such movement is slowed as indicated at $F_1$. A second time period $T_2$ during which pick-up head dwells at its lowermost point as indicated at $F_2$, and a third time period $T_3$ during which the speed of the upward movement is slowed before the pick-up head resumes its normal speed of upward movement as represented by line U. It will also be noted that the finger elements are closed, without any delay, as soon as the pick-up head reaches its lowermost position $F_1$.

Figure 10:
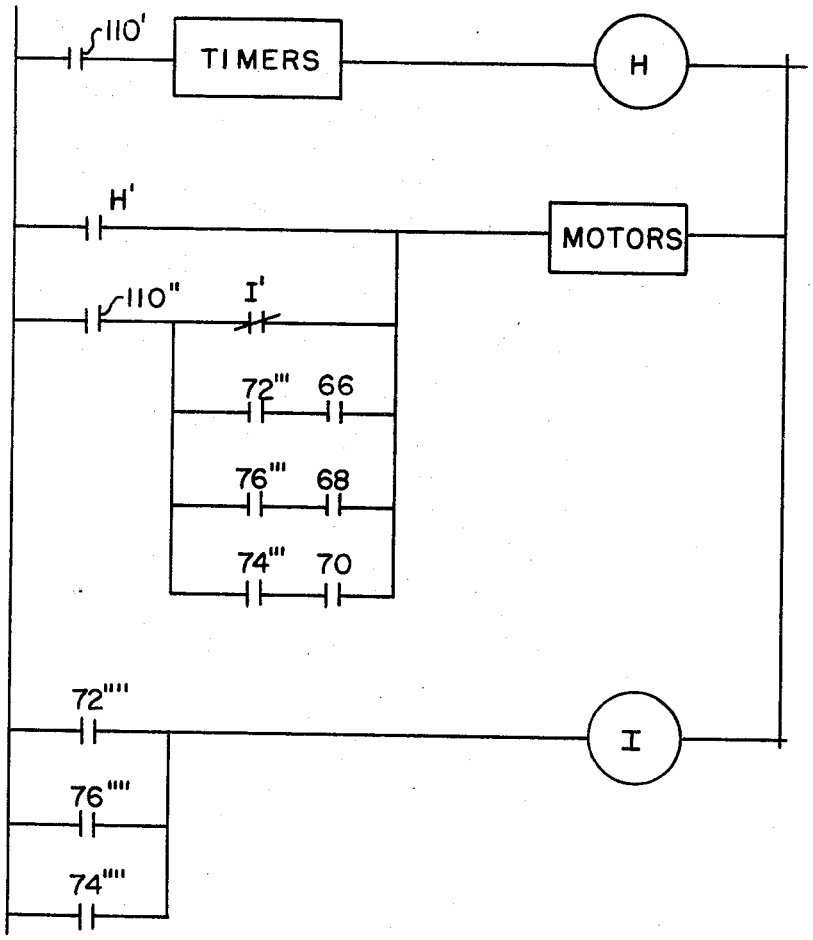
FIG. 10 is a diagrammatic illustration of an exemplary "Light or Heavy Determination" circuit represented in FIG. 9.

The foregoing sequence of events is obtained from the control circuit shown in simplified and diagrammatic form in FIG. 10 where the box "TIMERS" represents collectively the time delays described above in connection with the movement of the pick-up head and the finger elements, and where the box "MOTOR" represents collectively the motors for the pick-up head and the finger elements. Also, FIG. 10 includes controls 66, 68 and 70 which correspond to contacts represented by the reference numerals in FIG. 6, and contacts 72''' and 72'''' operated by relay 72 in FIG. 6 and similar contacts operated by relays 74 and 76 in FIG. 6.

Each time the pick-up moves downwardly to the point where the feeler element 104 on the pick-up head 18 engages the top surface of the first bale in the pick-up sequence, this feeler element 110 closes a switch represented by contacts 110' and 110'' in FIG. 10. The closing of contact 110'' immediately completes a circuit through normally closed contact I' and the "MOTORS" to thereby operate the motors of the pick-up head and finger elements in their normal manner to obtain a light pick-up as described above, it being noted also that the relay H and its contact H' are rendered ineffective because of the time delays represented by the TIMERS will not close relay H until after the MOTORS have already been energized through closed contacts 110'' and I'. This operation represents the normal operation of the pick-up head 18 by which it makes a light pick-up from all bales.

However, when one of the bales is reduced in height below a predetermined heights (e.g. below level A in FIG. 4), the counter 52 will energize the relay (72, 74 or 76) corresponding to the bale which is low, all as described above in connection with FIG. 6. Assuming it is the first bale in the sequence which is below the predetermined level, normally open switch 66 will be closed as described above in connection with FIG. 6, and relay 72 in FIG. 6 will be energized to close normally open contacts 72''' and 72'''' in FIG. 10, and these last two contacts will thereafter remain closed until the circuit is reset as will be described presently. The closing of contact 72'''' energizes relay I which opens contact I' which will likewise remain open until the circuit is reset. This, with the first bale being below the aforesaid predetermined level, the pick-up head 18 will make a normal light pick-up because of the closed circuit for the "MOTORS" through closed contact 110'', and closed contacts 72''' and 66 which by pass the now open contact I'.

After the pick-up for the first bale has been completed and the carriage 16 and pick-up head 18 are moved to a position above the second bale, the switch 66 will open and switch 68 will be closed as described above. Assuming that the height of the second bale is not below the predetermined level, the contact 76''' will not be closed by relay 76 (FIG. 6) and therefore the subcircuit through 76''' and 68 will be open, and the other two subcircuits in parallel with now open contact I' will also be open because of open contacts 66 and 70. Accordingly, the closing of contact 110' by the descending pick-up head 18 will complete a circuit through the TIMERS and relay H, to close contact H' and complete a circuit through the MOTORS. However, because of the time delay imposed by the various motors by the TIMERS as discussed above, the closing of the finger elements 110 will occur at a point closer to the bale thereby resulting in a heavy pick-up for the second bale.

If, when the pick-up head 18 moves to the third bale in the sequence, the level of this bale is higher than the predetermined level, the contact 74''' will remain open so that no immediate circuit is completed through the MOTORS, and there will be a time delay imposed on the finger elements 100 in the same manner as that described above in connection with the second bale.

Thus, in this hypothetical condition of the bales, a light pick-up will be made from the first bale which is below the predetermined level, and heavy pick-ups will be made from the second and third bales which are above such level. This will continue until either the second or third bale is depleted to a point that its height is below the predetermined level. Thus, assuming it is the second bale, when the pick-up head 18 descends to the point where it contacts the second bale, the contact 76''' will be closed by relay 76 (FIG. 6), thereby resulting in an immediate completion of the circuit through closed contact 110'', 76''', 68 and the MOTORS, whereby the second bale will thereafter receive a light pick-up in the same manner as that described in connection with the first bale. Similarly, if the third bale reaches a level below the predetermined level before the second bale, it will thereafter receive a light pick-up like the first bale because of the closing of contact 74''' and contact 70.

When all three bales in the sequence have reached a level below the predetermined level, it will be noted that contacts 72''', 74''', 76''', 72'''', 74'''' and 76'''' will all be reset by the relays 72, 74, and 76 in the circuit of FIG. 6, as described above, and all of these contacts will assume their open condition as shown in FIG. 10. Accordingly, oce all of the bales are below the predetermined level, all bales will receive a light pick-up. However, as describe above in connection with FIG. 6, the counters 52 and 52' may be designed to reflect a plurality of predetermined levels, such as levels A, B, and C in FIG. 4, so that after the circuit of FIG. 10 is reset, it will continue to control the light and heavy pick-ups for the lower predetermined levels in the same manner as just described.

It will be apparent that this second embodiment of the present invention results in all bales behind a hopper receiving a pick-up, in sequence, each time such hopper requires additional fiber, but relatively smaller amounts of fiber will be picked up from any bale which is below a predetermined level and relatively larger amounts of fiber are picked up from bales above the predetermined level, thereby assuring a relatively even exhaustion of all bales while still obtaining a good blend of fibers from all of the bales.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. In combination with apparatus for removing fiber portions from a selected plurality of bales of fiber disposed adjacent said apparatus, said apparatus including head means selectively movable from a first position spaced from a bale to a second position in contact with said bale for removing fiber therefrom, and including primary control means for causing said head means to be transported to positions adjacent each of said selected plurality of bales in a predetermined sequence to remove fibers therefrom, the improvement comprising:

(a) means for generating a signal when said head means has traveled a predetermined distance in moving from said first position thereof to said second position thereof while removing fiber from any one of said selected plurality of bales; and (b) secondary control means for receiving said generated signal and thereafter varying said predetermined sequence of fiber removal by preventing said head means from removing fibers from said one bale until another said signal is received from said signal generating means while said head means is removing fiber from at least one of the others of said selected plurality of bales.

2. The combination defined in claim 1 and further characterized in that said apparatus includes support means for supporting said head means above said selected plurality of bales during said transportation of said head means to said positions adjacent ecah of said bales, in that rotatable driving means is provided for moving said head means from said first position thereof to said second position thereof, and in that said signal generating means is responsive to a predetermined number of revolutions of said rotatable driving means for generating said signal.

3. In combination with apparatus for removing fibers from a selected plurality of bales and delivering said removed fiber to receiver means located adjacent said bales, said apparatus including head means for removing fibers from said bales, transport means for moving said head means in a path of movement extending over all of said selected plurality of bales, and primary control means for causing said head means to move in a predetermined sequence to selected positions above each of said bales, to move downwardly from a predetermined raised disposition untill said head means contacts said bale and removes fiber therefrom, to move upwardly to said predetermined raised position, and to move to a position over said receiver means and release said removed fiber into said receiver means, the improvement comprising:

(a) means for generating a signal each time said head means has moved downwardly for a predetermined distance from said raised position thereof to remove fibers from any one of said selected plurality of bales; and (b) secondary control means responsive to said generated signals to vary said predetermined sequence of movement of said head means by preventing said head means from removing fibers from any bale for which a said signal has been generated until a said signal has been generated for every bale in said selected plurality of bales.

4. The combination defined in claim 3 and further characterized in that said secondary control means is operative to cause said head means to return to said predetermined sequence of movement after a said signal has been generated for every bale in said selected plurality of bales.

5. The combination defined in claim 3 and further characterized in that said transport means includes an elevated track system and carriage means movable along said track system to said selected position above each of said bales, said head means being carried by said carriage means and being operated by a rotatable drive means which causes said head means to move downwardly from said predetermined raised position of said head means, and in that said signal generating means is responsive to the number of revolutions of said rotatable drive means to generate said signal when a predetermined number of said revolutions have occurred.

6. In combination with apparatus for removing fibers sequentially from a selected plurality of bales located in predetermined bale locations adjacent a receiver means and for delivering said fibers to said receiver means, said apparatus including head means normally movable in a predetermined sequence to a position above each of said bale locations for removing fibers from the bale at said bale location and then delivering said removed fibers to said receiver means, the improvement comprising means for sensing the vertical height of each bale in said selected plurality of bales, and control means responsive to said sensing means for causing said head means to sequentially remove fiber from all bales in said selected plurality of bales which have a vertical height greater than a first predetermined vertical dimension while preventing said head means from removing fibers from any bale having a vertical height which is less than said predetermined vertical dimension.

7. The combination defined in claim 6 and further characterized in that said sensing means generates a first signal each time the sensed vertical height of said bale is less than said first predetermined vertical dimension and generates a second signal each time the sensed vertical height of a bale is less than a second predetermined vertical dimension, said second predetermined vertical dimension being less than said first predetermined vertical dimension, and in that said control means is responsive to said sensing means for causing said head means to sequentially remove fibers from all of said selected plurality of bales after the vertical heights thereof are all beneath said first predetermined vertical dimension until said sensing means generates one said second signal whereupon said control means thereafter causes said head means to sequentially remove fibers from all bales which have a vertical height greater than said second predetermined vertical dimension while preventing said head means from removing fibers from any bale having a vertical height which is less than said second predetermined vertical dimension.

8. In combination with apparatus for removing fiber portions from a selected plurality of bales of fibers disposed adjacent said apparatus, said apparatus including head means selectively movable from a first position spaced from a bale to a second position adjacent such bale to remove fiber therefrom, and including primary control means for causing said head means to be transported to locations adjacent each of said selected plurality of bales in a predetermined sequence to remove fibers from at least some of said bales, the improvement comprising:

(a) means for generating a signal when said head means has traveled a predetermined distance in moving from said first position thereof to said position thereof while removing fiber from any one of said selected plurality of bales; and (b) secondary control means for receiving said generated signal and then controlling the operation of said head means to pick up less fiber from any bale for which a signal has been generated than is picked from the remaining bales in said selected plurality of bales.

9. The combination defined in claim 8 and further characterized in that said secondary control means, upon receiving said generated signal, causes said head means to pick up fibers from one or more of said bales and prevents said head means from picking up fiber from the remainder of said bales.

10. The combination defined in claim 8 and further characterized in that said secondary control means, upon receiving said generated signal, causes said head means to pick-up a relatively smaller amount of fibers from one or more of said bales and a relatively larger amount of fiber from the remainder of said bales.

11. The combination defined in claim 8 and further characterized in that said apparatus includes support means for supporting said head means above said selected plurality of bales during said transportation of said head means to said location adjacent each of said bales, in that rotatable driving means is provided for moving said head means from said first position thereof to said second position thereof, and in that said signal generating means is responsive to a predetermined number of revolutions of said rotatable drive means for generating said signal.

12. In combination with apparatus for removing fiber portions from a selected plurality of bales of fibers disposed adjacent said apparatus, said apparatus including head means selectively movable from a first position spaced from a bale to a second position adjacent such bale to remove fiber therefrom, and including primary control means for causing said head means to be transported to locations adjacent each of said selected plurality of bales in a predetermined sequence to remove fibers from at least some of said bales, the improvement comprising:

(a) means for generating a signal when said head means has traveled a predetermined distance in moving from said first position thereof to said position thereof while removing fiber from any one of said selected plurality of bales; and (b) secondary control means for receiving said generated signal and thereafter causing said head means to pick-up fiber from said one bale in a lesser amount than is picked up from at least some of the remaining bales in said selected plurality of bales.

13. The combination defined in claim 12 and further characterized in that said secondary control means, upon receipt of said generated signal, causes said head means to thereafter continue picking up the same amount of fiber from said bale as was picked up prior to the receipt of said generated signal, and to pick-up a larger amount of fiber from all remaining bales in said selected plurality of bales until another signal is received from said signal generating means while said head is removing fiber from at least one of said remaining bales.

14. The combination defined in claim 12 and further characterized in that said secondary control means causes said head means to pick up a relatively small amount of fiber from each bale for which a signal has been generated by said signal generating means during the picking up of fibers therefrom and to pick up a relatively large amount of fibers from all of the remaining bales in said selected plurality of bales.

15. The combination defined in claim 12 and further characterized in that said head means includes a plurality of pivoted finger elements operated by motor means to close said finger elements to remove said fiber from said bales, and in that said secondary control means is operable, upon receipt of said generated signal, to regulate said motor means and cause said fingers to pick-up said lesser amounts of fiber from at least some of said bales in said selected plurality of bales.

16. The combination defined in claim 15 and further characterized in that said motor means for closing said finger elements is energized when said head means reaches a first predetermined spacing from a bale when said lesser amount of fiber is to be removed therefrom and is energized when said head means reaches a second predetermined spacing from a bale when said greater amount of fiber is to be removed therefrom, said second predetermined spacing being less than said first predetermined spacing.

17. The combination defined in claim 15 and further characterized in that said primary control means causes said head means to move downwardly from said first position thereof to said second position thereof and to then return upwardly to said first position at a predetermined speed of movement and causes said motor means for said finger elements to begin closing said finger elements when said head means reaches a predetermined spacing from the surface of a bale, and in that said secondary control means, upon receipt of said generated signal, slows down said speed of movement of said head means as it approaches and leaves said second position thereof adjacent any bale from which said greater amount of fiber is to be removed.

18. In combination with apparatus for removing fiber portions from a selected plurality of bales of fibers disposed adjacent said apparatus, said apparatus including head means selectively movable from a first position spaced from a bale to a second position adjacent such bale to remove fiber therefrom, and including primary control means for causing said head means to be transported to locations adjacent each of said selected plurality of bales in a predetermined sequence to remove fibers from at least some of said bales, the improvement comprising:

(a) means for sensing the height of a bale during the moement of said head means between said first and second positions with respect to said bale and for generating a signal when said sensed bale height is below a predetermined vertical height; and (b) second control means for receiving said generated signal and thereafter controlling the operation of said head means to remove substantially less fibers from any bale having a height less than said predetermined vertical height than is picked up from any bale which has a height above said predetermined height.

19. The combination defined in claim 18 and further characterized in that said secondary control means causes said head means to pick up fibers from any bale having a height above said predetermined vertical height prevents said head means from picking up fibers from any bale having a height less than said predetermined vertical height.

20. The combination defined in claim 18 and further characterized in that said secondary control means causes said head means to pick up fiber from all of said plurality of bales, and to pick up a relatively greater amount of fibers from bales having a height above said predetermined vertical height and to pick up a relatively smaller amount of fibers from bales having a height below said predetermined height.

* * * * *